US007621485B2

(12) United States Patent
Logosz et al.

(10) Patent No.: US 7,621,485 B2
(45) Date of Patent: Nov. 24, 2009

(54) TRIM LINE KITE CONTROL SYSTEM

(76) Inventors: Tony Logosz, 1413 A St., Hood River, OR (US) 97031; John Doyle, 9 Oakleaf La., White Salmon, WA (US) 98672

( * ) Notice: Subject to any disclaimer, the term of this patent is extended or adjusted under 35 U.S.C. 154(b) by 774 days.

(21) Appl. No.: 11/100,911

(22) Filed: Apr. 6, 2005

(65) Prior Publication Data

US 2008/0067291 A1 Mar. 20, 2008

(51) Int. Cl.
*A63H 27/08* (2006.01)

(52) U.S. Cl. ..... 244/155 A

(58) Field of Classification Search ..... 244/153 R, 244/155 R, 155 A

See application file for complete search history.

(56) References Cited

U.S. PATENT DOCUMENTS

| | | | | |
|---|---|---|---|---|
| 4,286,762 | A * | 9/1981 | Prouty | 244/153 R |
| 6,514,115 | B2 * | 2/2003 | Harich | 446/34 |
| 6,520,454 | B2 * | 2/2003 | Winner | 244/155 A |
| 6,581,879 | B2 * | 6/2003 | Bellacera | 244/155 A |
| 6,691,954 | B1 * | 2/2004 | Harrington et al. | 244/155 A |
| 6,830,220 | B2 * | 12/2004 | Runyan | 244/155 A |
| 6,869,047 | B2 * | 3/2005 | Pouchkarev | 244/155 A |
| 6,877,697 | B2 * | 4/2005 | Bellacera | 244/155 A |
| 7,017,860 | B2 * | 3/2006 | Royannais et al. | 244/155 A |
| 7,036,771 | B1 * | 5/2006 | Pouchkarev | 244/155 A |
| 7,182,294 | B2 * | 2/2007 | Blackman | 244/155 A |
| 2004/0182968 | A1 * | 9/2004 | Gentry | 244/155 A |
| 2005/0133669 | A1 * | 6/2005 | Royannais et al. | 244/155 A |
| 2005/0230556 | A1 * | 10/2005 | Legaignoux et al. | 244/153 R |
| 2006/0226294 | A1 * | 10/2006 | Logosz et al. | 244/152 |
| 2007/0120016 | A1 * | 5/2007 | Eberle et al. | 244/153 R |
| 2008/0035796 | A1 * | 2/2008 | See et al. | 244/155 A |

* cited by examiner

*Primary Examiner*—Michael Carone
*Assistant Examiner*—Joseph W Sanderson

(57) ABSTRACT

A kite control system including an aerodynamic wing with a leading edge and first and second opposing wingtips, a control device, a first steering line secured to the first wingtip and the control device, a second steering line secured to the second wingtip and the control device, and a trim line secured to the leading edge substantially between the opposing wingtips, wherein the trim line has a user adjustable length device that allows the user to adjust and mechanically fix the length of the trim line while the aerodynamic wing is in flight.

18 Claims, 9 Drawing Sheets

TRIM LINE KITE CONTROL SYSTEM

FIELD OF THE PRESENT INVENTION

The present invention relates generally to inflatable power or traction kites having improved attitude control, flying characteristics and safety. More particularly, the invention relates to an inflatable kite having an adjustable trim line attached to the middle of the leading edge.

BACKGROUND OF THE INVENTION

Considerable effort is being expended to develop wings capable of generating tractive force for the purposes of powering a user on a variety of vehicles that are tethered solely by flexible lines. Such wings can generally be considered kites. The development of kites capable of generating significant force has made possible numerous recreational pursuits. For example, kite surfing or kite boarding refers to a sport involving the use of a wind powered wing to pull the participant on a vehicle across a body of water. Similar sports involving the use of appropriately configured vehicles to traverse sand, earth, snow and ice are also being pursued. One of skill in the art will also recognize that wind powered wings can be used in any number of other applications, whether recreational or practical. With the development of these applications has come an increasing demand for kites having improved characteristics.

One type of kite that has achieved popularity is a leading edge inflatable ("LEI") kite, typically comprising a semi-rigid framework of inflatable struts or spars that support a canopy to form the profile of the wing. This basic design is taught by U.S. Pat. No. 4,708,078 to Legaignoux, et al. The development of the LEI kite is generally credited with spurring the development of modern kite surfing due to its ability to be relaunched from the water's surface.

Despite the popularity of LEI kite designs, they do suffer from certain, inherent challenges. The most successful LEI kites currently employ a four-line control system, in which two steering lines are secured to the trailing edge and two front lines are secured to the leading edge. Altering the relative length between the steering lines and the front lines adjusts angle of attack, or the trim, of the kite.

As can be appreciated, the degree of control an operator has over the aerodynamic characteristics of the kite can help optimize its usefulness. For example, aerodynamic efficiency, relaunchability, performance, safety, handling and power management are all interrelated aspects of the kite's design and the control system used to fly the kite. In one instance, attempts to improve the performance of a kite often involve increasing the aspect ratio of the wing. However, the ability of the kite to be relaunched tends to be inversely related to the aspect ratio. Likewise, one aspect of a kite's efficiency is its lift to drag ratio, but increasing this ratio can have adverse effects on the handling of the kite. Yet another example is the balance between trim control and steering. By positioning the attachment of the front line closer to the steering line on the wingtip, a greater range of attitude can be effected given the same relative change in length between the steering line and the front line. However, the turning speed of the kite is improved by increasing the width of the wingtip, which tends to increase distance between the front line attachment and steering line attachment.

Thus, conventional kite design often involves balancing between two or more competing attributes, wherein the entire system is subject to the constraints of the amount of control available.

The issue of safety, as referenced above, is also an important factor in the design of a LEI kite system. Power kites are capable of generating large forces that contribute to the enjoyment of the sport. However, these same forces can also pose significant safety hazards to the user and to bystanders when inadequate control is provided. This can occur if the wind strength increases beyond an acceptable amount, if the user does not or cannot utilize the control system appropriately or if the control system becomes compromised, such as by twisting, tangling or breaking the lines. Therefore, most kite designs and control systems offer a means for substantially reducing the amount of power exerted by the kite. Conventional systems include methods of restraining one of either the front lines or the steering lines while allowing a significant amount of slack in the remaining lines. Ideally, this has the effect of corrupting the aerodynamic profile of the kite so that essentially all the lifting forces are extinguished. However, the conventional systems suffer from a number of drawbacks, including the possibility that the kite will not adequately depower, the significant chance that the lines will become tangled and the difficulty in relaunching the kite after it has been depowered.

One prior art technique for improving safety is the inclusion of another control line, a fifth line that is secured to the leading edge. These systems recognize the ability to effectively depower the kite by tensioning the fifth line while slackening the remaining four lines. Some of these systems also recognize that the fifth line can also impart some structural stability to the kite by restraining the leading edge. Indeed, certain fifth line systems employ a bridle arrangement to help lock the curvature of the leading edge. Thus, conventional fifth line systems do offer a complete depower function and the potential for increased stability. However, such systems do not provide a means for selectively controlling the aerodynamic profile of the kite during flight to improve the handling characteristics. The prior art systems also fail to offer a method for dynamically varying and fixing tension on the fifth line to trim the kite while flying.

Accordingly, it is an object of the present invention to provide a control system for a LEI kite design that offers improved aerodynamic control.

It is also an object of the present invention to provide a control system for a LEI kite design that offers enhanced adjustment of the kite's angle of attack as compared to conventional four-line control systems.

It is another object of the present invention to provide a control system for a LEI kite design that provides modification of the kite's projected area.

It is yet another object of the present invention to provide a control system for a LEI kite design that allows a user to completely depower the kite without tethering to the steering lines or the front lines.

It is an also an object of the present invention to provide a method for controlling a LEI kite that offers improved adjustment of the kite's performance characteristics.

SUMMARY OF THE INVENTION

In accordance with the above objects and those that will be mentioned and will become apparent below, the present invention is a system including an aerodynamic wing with a leading edge and first and second opposing wingtips, a control device, a first steering line secured to the first wingtip and the control device, a second steering line secured to the second wingtip and the control device, and a trim line secured to the leading edge substantially between the opposing wingtips, wherein the trim line has a user adjustable length device that allows the user to adjust and mechanically fix the length of the trim line while the aerodynamic wing is in flight.

The invention comprises embodiments wherein the trim line is configured to be secured to the control device and embodiments wherein the trim line is configured to be releasably secured to a user. In all embodiments, the trim line has the user adjustable length device positioned adjacent the user. A number of suitable user adjustable length devices may be used in the practice of the invention, all of which allow a user to adjust the length of the trim line and then mechanically fix the line so that the trim line remains at the desired length without additional interaction from the user. Preferably, the user adjustable length device comprises a friction cleat, cam cleat, buckle or other similar device that allows ready fixing of the line at the device, yet can easily be disengaged so that a different trim line length can be set if desired. Further, the user adjustable length device can comprise a pulley arrangement to provide the mechanical advantage of the pulley's purchase.

In other embodiments of the invention, the system further comprises two front lines, each secured to the first and second opposing wingtips adjacent the leading edge. In one embodiment, the front lines are secured to the control device. In another embodiment, the front lines are adapted to be releasably secured to a user.

In a currently preferred embodiment, the system comprises a control device configured as a bar, with the steering lines secured to opposing ends of the bar and with the front lines and trim line releasably secured to a user through an aperture in the control device.

In other embodiments of the invention, the aerodynamic wing has an angle of attack and a projected area. The trim line is configured to adjust the angle of attack in a range between a first position and a second position or to adjust the projected area between a first amount and a second amount. In the noted embodiments, the user adjustable length device is configured to fix the trim line at lengths corresponding to an angle of attack between the first position and the second position or at lengths corresponding to a projected area between the first amount and the second amount. Preferably, both angle of attack and projected area is adjusted by fixing the trim line at varying lengths.

The invention also comprises methods for controlling an aerodynamic wing having a leading edge and first and second opposing wingtips, comprising the steps of providing a control device, a first steering line secured to the first wingtip and the control device, a second steering line secured to the second wingtip and the control device, and a trim line secured to the leading edge between the opposing wingtips, varying the length of the trim line from a first length to a second length while the aerodynamic wing is in flight, and mechanically fixing the trim line at the second length.

Preferably, the angle of attack of the aerodynamic wing is altered by varying the length of and mechanically fixing the trim line. Also preferably, the projected area of the aerodynamic wing is altered by varying the length of and mechanically fixing the trim line. Even more preferably, both the angle of attack and the projected area are altered by varying the length of and mechanically fixing the trim line.

In other embodiments, the method further comprises increasing the aerodynamic lift by shortening and mechanically fixing the trim line.

In yet other embodiments, the control device further comprises front lines secured to the wingtips adjacent the leading edge, and the method further comprises positioning the aerodynamic wing further forward in a wind window by shortening the trim line and increasing the length of the steering lines relative to the front lines.

BRIEF DESCRIPTION OF THE DRAWINGS

Further features and advantages will become apparent from the following and more particular description of the preferred embodiments of the invention, as illustrated in the accompanying drawings, and in which like referenced characters generally refer to the same parts or elements throughout the views, and in which.

DETAILED DESCRIPTION OF THE INVENTION

Before describing the present invention in detail, it is to be understood that this invention is not limited to particularly exemplified materials, methods or structures as such may, of course, vary. Thus, although a number of materials and methods similar or equivalent to those described herein can be used in the practice of the present invention, the preferred materials and methods are described herein.

It is also to be understood that the terminology used herein is for the purpose of describing particular embodiments of the invention only and is not intended to be limiting.

Unless defined otherwise, all technical and scientific terms used herein have the same meaning as commonly understood by one having ordinary skill in the art to which the invention pertains.

Further, all publications, patents and patent applications cited herein, whether supra or infra, are hereby incorporated by reference in their entirety.

Finally, as used in this specification and the appended claims, the singular forms "a, "an" and "the" include plural referents unless the content clearly dictates otherwise.

The present invention is an aerodynamic wing having a lifting surface with a leading edge, a trailing edge, and a flexible canopy that substantially forms a lifting surface. In a presently preferred embodiment, the wing is a power or traction kite having an inflatable leading edge design. Also preferably, the kite is controlled by two steering lines and two front lines in conjunction with a trim line. As will be described in detail, the trim line has a variable length that is adjustable and can be mechanically fixed by the user while the kite is in flight.

Figure 1:
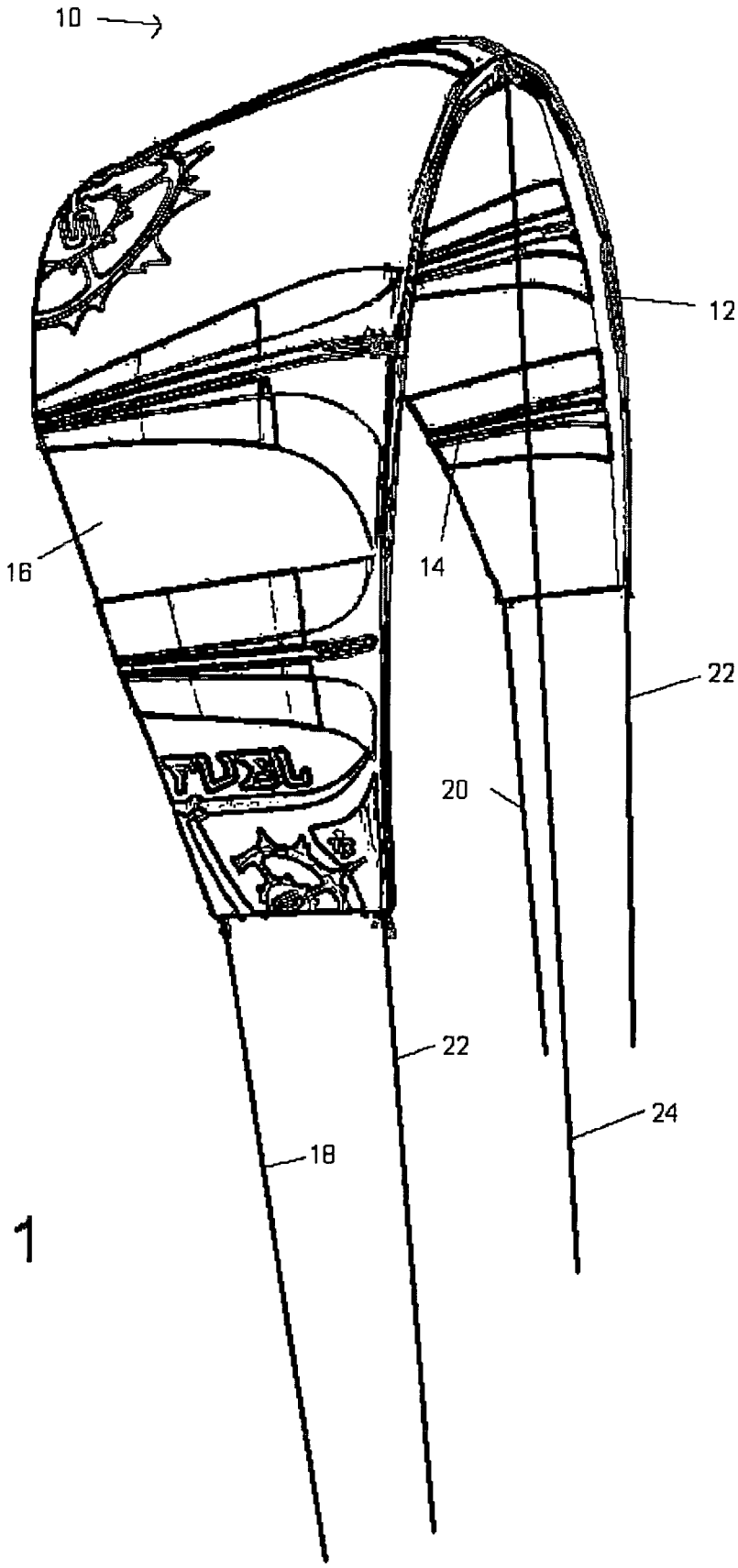
FIG. 1 is a perspective view of a LEI kite embodying features of the invention.

Turning to FIG. 1, an inflatable leading edge (LEI) kite 10 is generally in the shape of an arc and comprises an inflatable strut 12 that forms the leading edge of kite 10. A plurality of rib inflatable struts 14 are aligned transversely with leading edge strut 12. A canopy 16 is secured to the framework created by struts 12 and 14 to form an airfoil capable of generating aerodynamic lift. Right and left steering lines 18 and 20 are attached to the wingtips of kite 10. Kite 10 as shown comprises front lines 22 which are attached the wingtips adjacent the leading edge inflatable strut 12. A trim line 24 is secured to kite 10 adjacent leading edge inflatable strut 12. As shown, trim line 24 is secured at one point substantially in the middle of the leading edge. Alternatively, multiple points of attachment can be used in conjunction with a bridle system, or the like.

Figure 2:
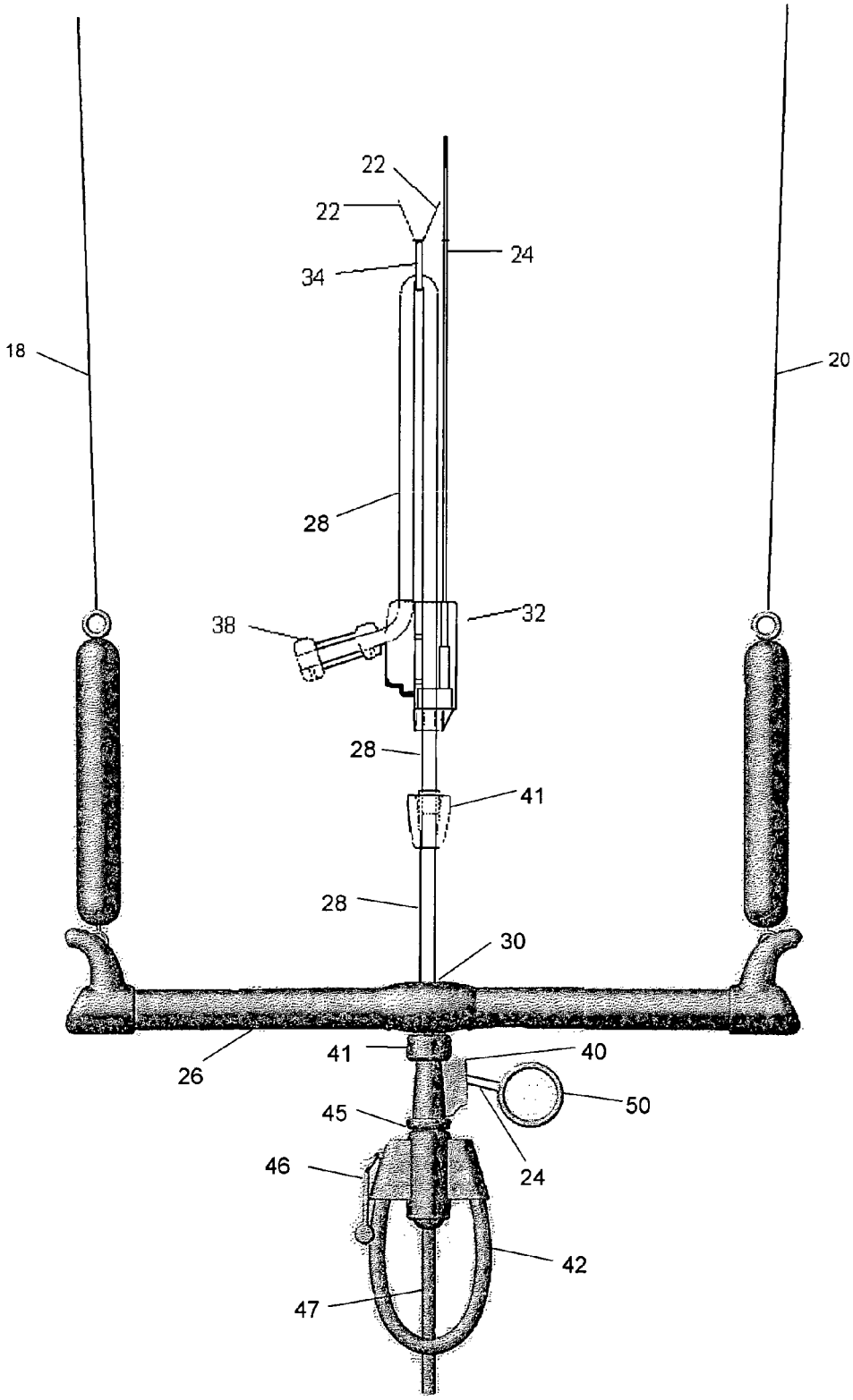
FIG. 2 is a perspective view showing a control device, according to the invention.

As shown in FIG. 2, a control device in the form of a bar 26 is used to transmit forces to and from steering lines 18 and 20, front lines 22 and trim line 24 to control kite 10. In particular, pivoting bar 26 tensions one steering line and slackens the other, causing kite 10 to turn. Front lines 22 are secured to chicken loop line 28 which passes through aperture 30 in control bar 26 and is then configured to be releasably secured to a user as described below. Aperture 30 can be formed in the control bar 26 or can be in the form of an opening secured to the bar, for example in the form of a fairlead. Thus, sliding control bar 26 up and down chicken loop line 28 changes the length of steering lines 18 and 20 relative to front lines 22 and sheets kite 10 by changing the angle of attack. Further, front lines 22 are equipped with a depower adjustment 32 that allows the user to adjust the relative length of front lines 22 independent of the position of control bar 26 along chicken loop line 28. Depower adjustment 32 as shown comprises chicken loop line 28 doubled back through a ring 34 that is secured to front lines 22 forming a pulley configuration. The distal end of chicken loop line 28 is secured using a cleat 36 attached to a proximal location. A handle 38 on the distal end of chicken loop line 28 facilitates adjustment. As one of skill in the art will recognize, cleat 36 allows the user to mechanically fix chicken loop line 28 at a position corresponding to a desired relative length of front lines 22.

The chicken loop line 28 configuration and depower adjustment 32 are used in a conventional manner to control the angle of attack of kite 10. Depower adjustment 32 establishes the sheeting range available to the user when moving the control bar up and down the chicken loop line 28. Generally, a user employs the depower adjustment 32 to adapt kite 10 to the prevailing wind conditions and moves the control bar 26 up and down chicken loop line 28 to provide immediate control over the kite's angle of attack, allowing the user to spontaneously generate more or less power in the kite as desired. Typically, a control bar is tuned so that maximum power is developed in kite 10 when depower adjustment 32 is set to provide the greatest extension of front lines 22 and when control bar 26 is fully sheeted in to maximize the length of front lines 22 relative to steering lines 18 and 20.

In addition to the conventional sheeting mechanisms described above, the present invention provides enhanced control over the aerodynamic profile of kite 10. Referring again to FIGS. 2 and 3, trim line 24 is routed through aperture 30 in control bar 26. A user adjustable length device 40 is secured to chicken loop line 28, allowing the length of trim line 24 to be varied and mechanically fixed, while kite 10 is in flight. User adjustable length device 40 is preferably a friction cleat, cam cleat, buckle or the like, such that the length of trim line 24 can be mechanically fixed at a desired amount and subsequently released. As discussed in detail below, changing the length of trim line 24 directly affects the angle of attack of kite 10, as well as improving control over other aspects of the kite's aerodynamic profile. In the preferred embodiments discussed herein, the user adjustable length device 40 is substantially secured to front lines 24 through chicken loop line 28. However, in other embodiments, the user adjustable length device could be secured directly to the control device, such as the control bar, or to the user.

Figure 3:
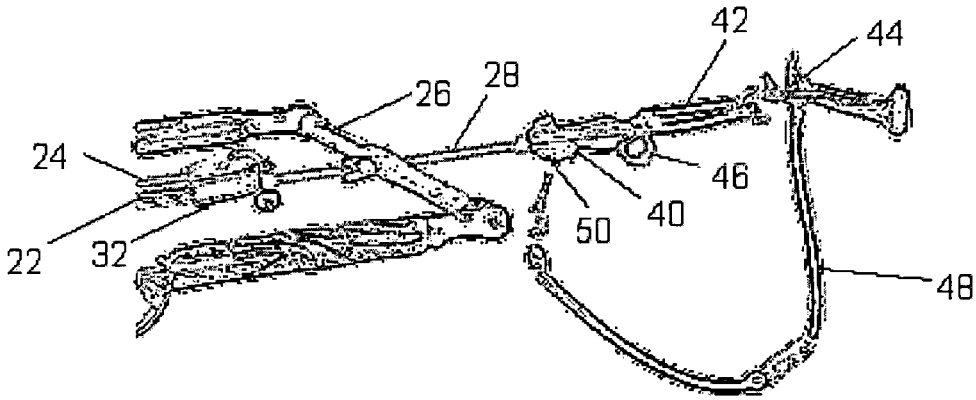
FIG. 3 is an alternate perspective view showing a control device, according to the invention.
Figure 4:
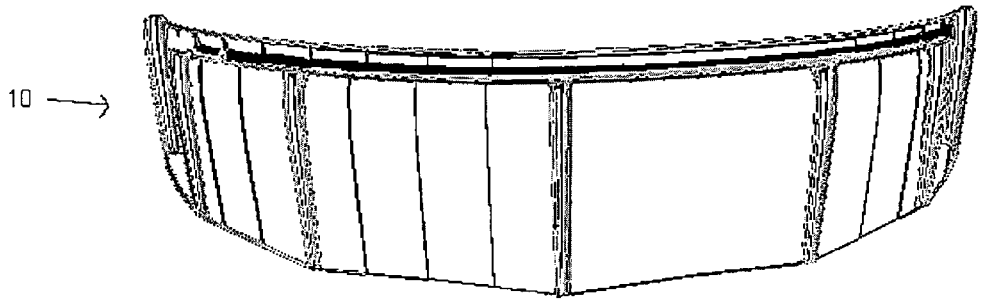
FIGS. 4-8 are perspective bottom views of a LEI kite showing different aspects of trim line control and sheeting control, according to the invention.
Figure 5:
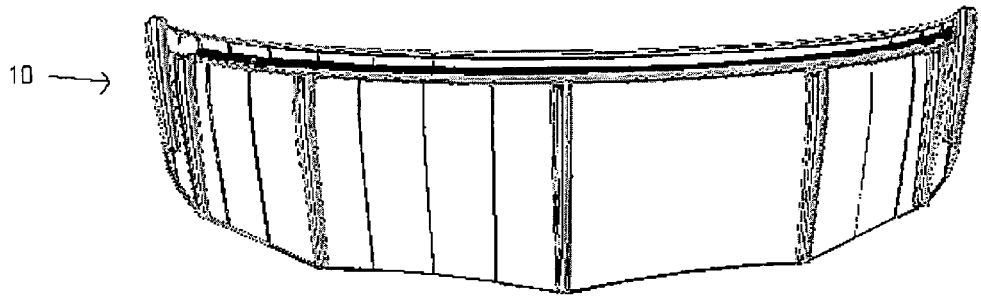
Figure 6:
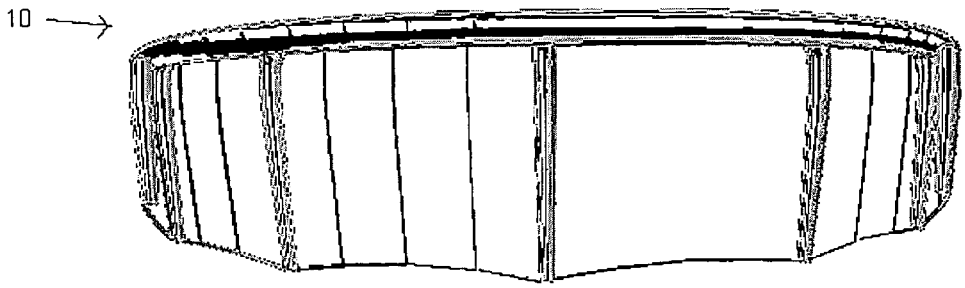

As shown in FIGS. 2 and 3, user adjustable length device 40 is preferably located proximal to the user from control bar 26. Also preferably, trim line 24 is routed coaxially within chicken loop line 28 through the region of chicken loop line 28 corresponding to the throw of control bar 26. Bumpers 41, made of a suitable compliant or compressible material, absorb shock when control bar 26 reaches the ends of the its range of motion along chicken loop line 28 and shield the routing mechanisms of trim line 24 through chicken loop line 28.

As shown, chicken loop line 28 terminates in a chicken loop 42, which is configured to allow ready engagement and disengagement with a harness hook 44 worn by the user. Preferably, chicken loop 42 is attached to chicken loop line 28 by a swivel attachment 45, such as a ball bearing race or other similar mechanism, and is conventionally formed by a tubing reinforced section of line, which will tend to hold the loop in an open position to allow ready engagement with hook 44. Chicken loop 42 has a quick release safety 46 that allows the user to open loop 42, releasing chicken loop line from hook 44 without unhooking. Chicken loop 42 can also have a length of tubing 47 that may be engaged with hook 44 to prevent chicken loop 42 from detaching from hook 44 unintentionally. Alternative configurations can also be employed, such as by terminating chicken loop line 28 with a rigid ring adapted to be retained by a shackle worn by the user, or other suitable methods.

The proximal location of user adjustable length device 40 allows convenient operation by the user and easy incorporation into a safety system, wherein the trim line 24 is restrained when the control bar 26 is dropped and the chicken loop line 28 is disengaged from the user. As shown in FIG. 3, a safety line 48 extends from the user's harness and may be removably attached to trim line 24 at or near handle 50.

As can be appreciated, the coaxial relation between trim line 24 and chicken loop line 28 together with the central routing of both lines through aperture 30 minimizes the potential for tangles and twists to develop in the control lines of the kite, even when the control bar and kite are rotated. Although the coaxial routing of trim line 24 is preferred, the trim line could also run adjacent chicken loop line through aperture 30. Further, the trim line 24 could also run directly to a user adjustable length device 40 located proximal to control bar 26 without passing through an aperture, although this can increase the risk of tangles and complicate the use of trim line 24 in a safety system.

For example, users of a kite may wish to perform spins, rotations or loops while flying the kite and may wish to loop the kite itself. All of these maneuvers will impart one or more twists in the control lines. Although such twists can be undone by performing the opposite maneuver, it is often more convenient to simply spin the control bar 26 in the appropriate direction, while maintaining the attachment of chicken loop line 28 to the user. In prior art systems, the safety line or one or more of the other control lines will develop twists or tangles when the control bar is spun on an axis about the chicken loop line. In the present invention, the control bar 26 can be freely spun around chicken loop line 28 without imparting twists between front lines 22 and trim line 24. In turn, this allows the user to quickly untwist the control lines following a sequence of maneuvers without creating additional twists or tangles. Further, the coaxial routing of trim line 24 within chicken loop line 28 presents the user with a clean and uncluttered control bar 26 set up. By minimizing the number of loose and exposed lines, the potential for snags and other interference is reduced.

The adjustment offered by the user adjustable trim line length of the present invention adds a substantial degree of control over the kite's performance characteristics when used in conjunction with the conventional depower adjustment 32 and chicken loop line 28 configuration described above. Specifically, adjusting the trim line length in conjunction with the conventional adjustments of the relative line lengths between the steering lines 18 and 20 and the front lines 22 allows the user to exert precise control over the angle of attack of kite 10 as well as effecting changes in the projected area.

Angle of attack is a critical parameter that effects almost all aspects of a given aerodynamic profile's performance characteristic. For example, angle of attack has a direct correlation to the amount of lifting force generated by the wing. The angle of attack also effects other aspects of the wing's flight such as the relative position of the wing in the wind window. As those having skill in the art appreciate, a kite can occupy a range of positions from forward in the window, that is, in a direction more aligned with the traveling direction of the user, to back in the window, that is, in a direction more perpendicular to the direction of travel. In general, a kite that is positioned further back in the window tends to generate more raw power. However, because of the kite location, that power is developed in a direction more perpendicular to the direction of travel. Some situations, such as accelerating from non-planing speeds and performing certain maneuvers, benefit from a kite that develops more power. Other situations, such as traveling upwind, benefit from a kite that is positioned forward in the window. Even though such a positioning may generate less overall power, the power is delivered in a direction more aligned with the direction of travel and results in a net improvement. Therefore, the ability of the user to adjust the positioning of the kite within the wind window represents a significant performance advantage.

Conventional control systems offer little or no control over the position of the kite within the wind window. Instead, prior art systems substantially rely upon the kite design to govern where the kite will sit in the window. Generally, kites that have been designed with a medium aspect ratio sit further back in the window and develop more power at slower speeds. Such designs can lose some efficiency at higher speeds and may have less upwind ability. Similarly, kites that are designed with a high aspect ratio often exhibit enhanced efficiency at speed and can improve upwind performance. However, high aspect ratio kites can suffer from a lack of power at lower speeds and may be more sensitive to variations in wind velocity. Therefore, users of prior art kites are typically confronted with a choice among competing characteristics and must sacrifice performance in certain areas to gain advantages in others.

In contrast, the present invention provides a control system wherein the position of kite 40 can be precisely controlled by varying the length of trim line 24 and fixing the tension at user adjustable length device 40. Specifically, decreasing the length of trim line 24 causes kite 10 to rotate forward, on a pivot approximately extending through the attachment point of front lines 22 adjacent the leading edge. The noted rotation forward generally makes the kite perform more like a high aspect ratio kite. In this mode, kite 10 sits further forward in the wind window, offering improved upwind ability and greater efficiency at speed. Similarly, increasing the relative length of trim line 24 causes kite 10 to rotate backward, making it perform more like a moderate aspect ratio kite. In this configuration, kite 10 sits further back in the wind window and generates more consistent, low end power. As one having skill in the art will appreciate, this allows a user to modify the characteristics of kite 10 to match changing conditions and demands. For example, it may be desirable to trim kite 10 to fly further back in the wind window to develop sufficient power at lower speeds. Once at speed, kite 10 can be trimmed to fly further forward in the window, to improve upwind ability or further back in the window, to develop consistent pull for maneuvers and tricks.

Another aspect of a kite's aerodynamic performance is its projected area. Given a conventional LEI kites curved profile, the projected area refers to the portion of the kite that is capable of generating lift parallel to the flying lines. Since this area is what represents the pull of the kite, the power of a kite is directly correlated to its projected area. While the projected area can be increased simply by making the kite larger, other design parameters can affect the projected area. For example, given kites having equivalent total area, a kite with a shallower angle of curvature will exhibit more projected area and will develop more power.

Conventional kites and control systems do not generally offer a means for controlling the projected area of a kite, particularly while the kite is in flight. Indeed, since conventional systems do not provide control over this characteristic, most designs attempt to restrain the kite shape to prevent changes in projected area. Although such stability offers more predictable handling characteristics, the range of suitable wind conditions for a given kite are limited.

The present invention, on the other hand, also provides a system and method for controlling the projected area of kite 10 to increase or decrease the overall power generated as desired. Accordingly, kites employing the invention can be used in a wider range of conditions and are suitable for a wider range of users. Specifically, reducing the length of trim line 24 with respect to front lines 22 and steering lines 18 and 20 allows the wingtips to spread, thus increasing the projected area of kite 10. Similarly, increasing the length of trim line 24 with respect to front lines 22 and steering lines 18 and 20 transfers more load to the wingtip lines, effectively drawing them together and decreasing the projected area of kite 10. Thus, adjusting the length of trim line 24 also controls the projected area of kite 10 and the power it can develop. A complementary benefit associated with the ability to modify the profile of the leading edge of kite 10 is that trim line 24 helps stabilize the shape in its modified configuration.

As discussed above, adjusting the length of trim line 24 imparts significant control over the aerodynamic performance of kite 10. By combining the control over the angle of attack and projected area with the conventional sheeting and depowering mechanisms, any number of performance enhancements can be gained in a wide variety of conditions.

For example, in one mode the user adjustable length device is engaged to shorten trim line 24 and depower adjustment 32 is set to provide the greatest extension of front lines 22. When control bar 26 is positioned from about the middle of its throw and inward on chicken loop line 28, kite 10 exhibits additional low end power because the projected area is increased. In this configuration, the kite also flies relatively further forward in the wind window. As with conventional systems, sheeting control bar 26 in further increases the power of kite 10. However, sheeting control bar 26 out in this mode effectively increases the aspect ratio of kite 10. Thus, providing kite 10 is moving at sufficient speed, enhanced upwind performance can be obtained by sheeting control bar 26 out. Engaging depower adjustment 32 substantially maintains these performance attributes, but attenuates the power of the kite in order to compensate for increased wind velocity or overpowered conditions.

As one of skill in the art will appreciate, various combinations of the controls can be selected to accommodate specific situations. For example, maximum low end power at minimal kite speed can be developed by fully sheeting in control bar 26 and shortening trim line 24 a moderate amount to increase the projected area of kite 10. Once kite 10 has reached flying speed, the aspect ratio of kite 10 can effectively be increased by further shortening trim line 24, providing improved upwind ability and enhanced efficiency at speed. Once at speed, sheeting control bar 26 fully out and returning trim line 24 to a moderate length provides maximum upwind performance by increasing the projected area and maintaining an effective high aspect ratio. Maximum speed can be obtained by fully engaging the user adjustable length device to minimize the length of trim line 24 while sheeting control bar 26 half way and engaging depower adjustment 32 at about half the available range. Finally, when optimum steering control is desired, depower adjustment 32 and user adjustable length device 40 should be fully disengaged to provide maximum extension of front lines 22 and maximum length of trim line 24.

Figure 7:
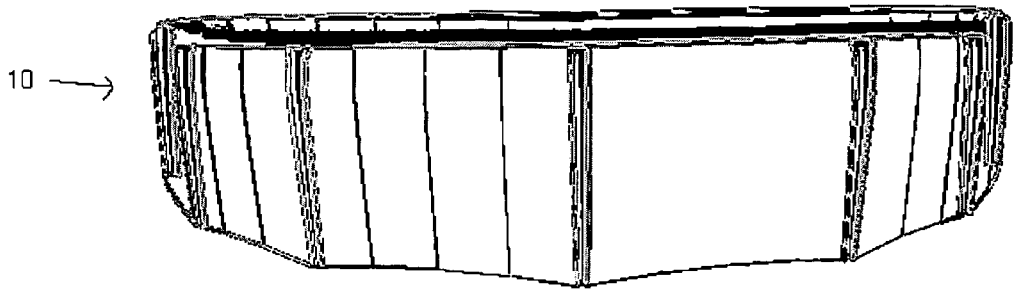
Figure 8:
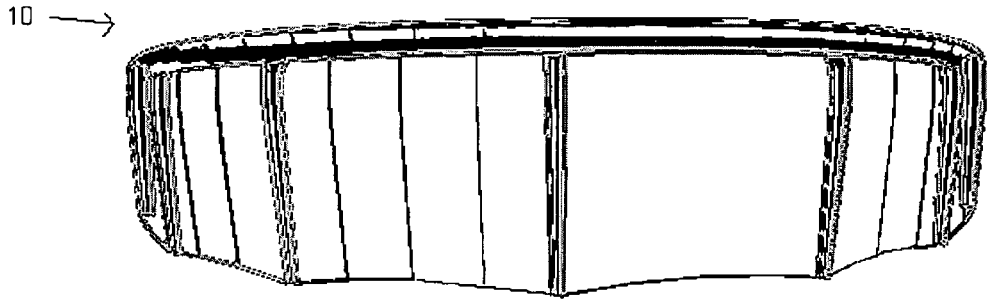
Figure 9:
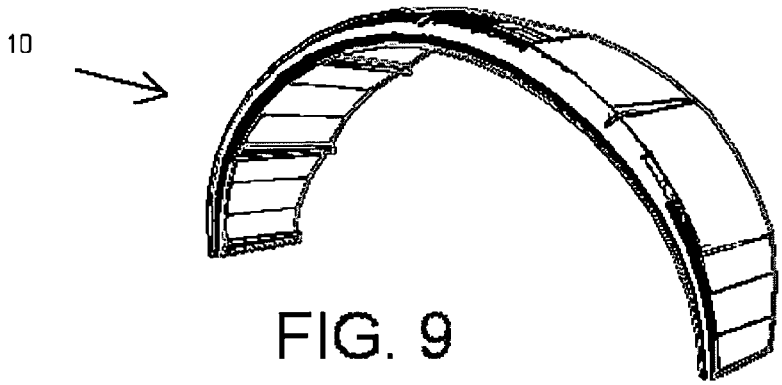
FIGS. 9-12 are perspective orthogonal views of a LEI kite showing different aspects of trim line control and sheeting control, according to the invention.
Figure 10:
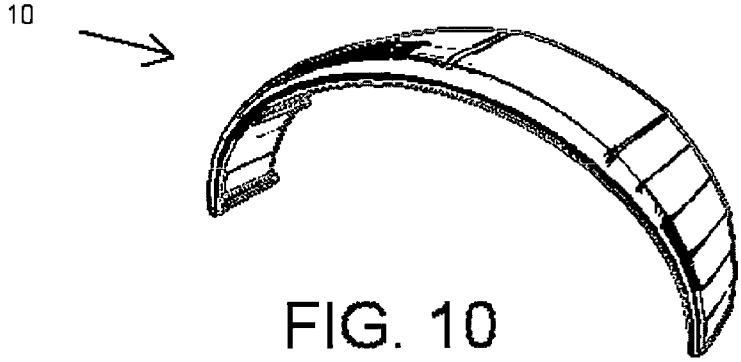
Figure 11:
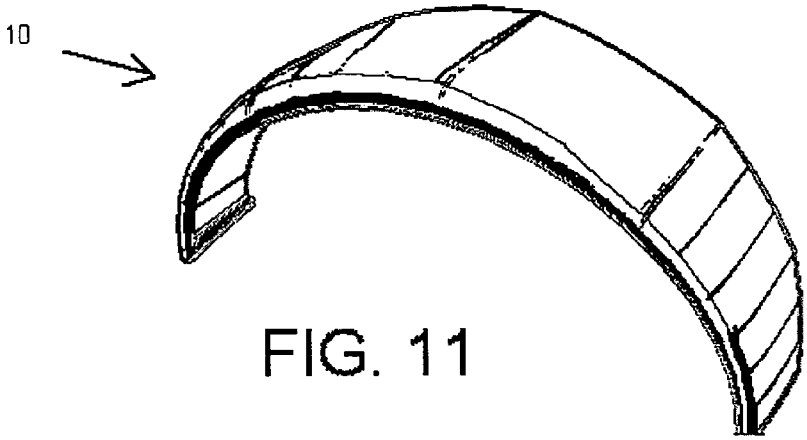
Figure 12:
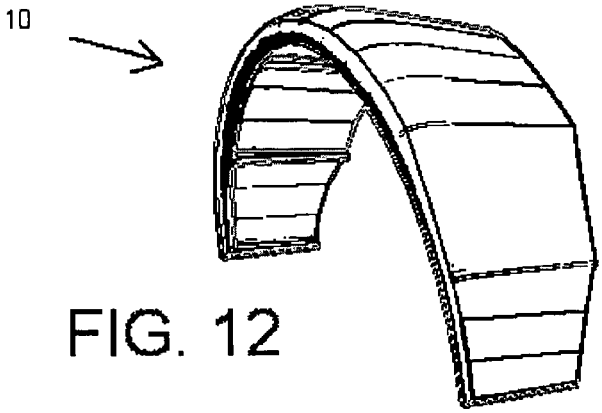
Figure 13:
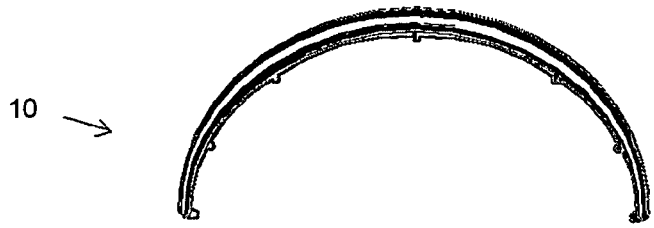
FIGS. 13-16 are perspective front views of a LEI kite showing different aspects of trim line control and sheeting control, according to the invention.
Figure 14:
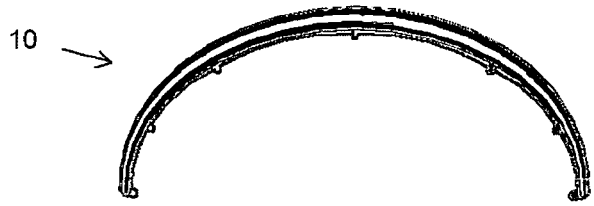
Figure 15:
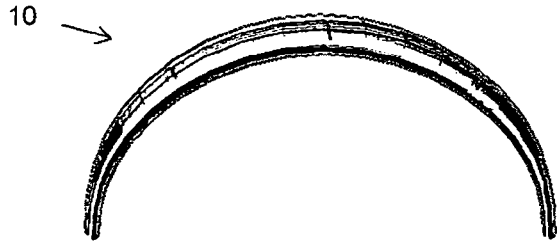
Figure 16:
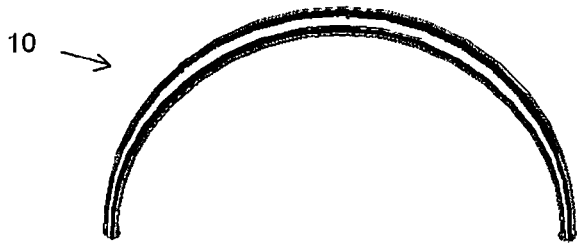
Figure 17:
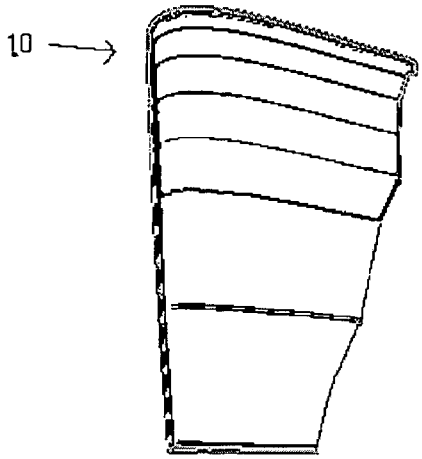
FIGS. 17-20 are perspective side views of a LEI kite showing different aspects of trim line control and sheeting control, according to the invention.
Figure 18:
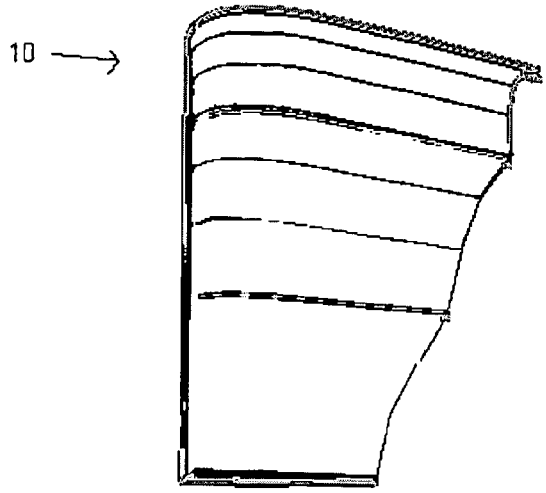
Figure 19:
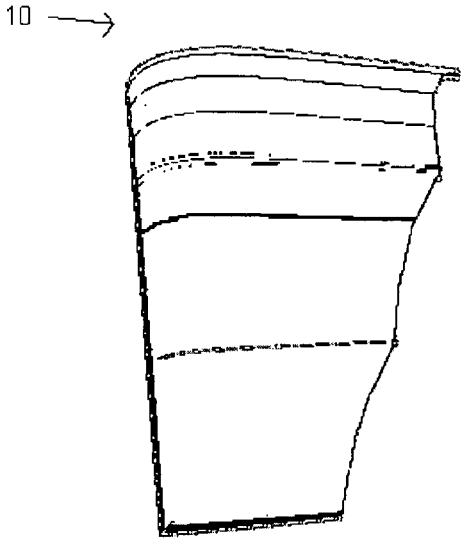
Figure 20:
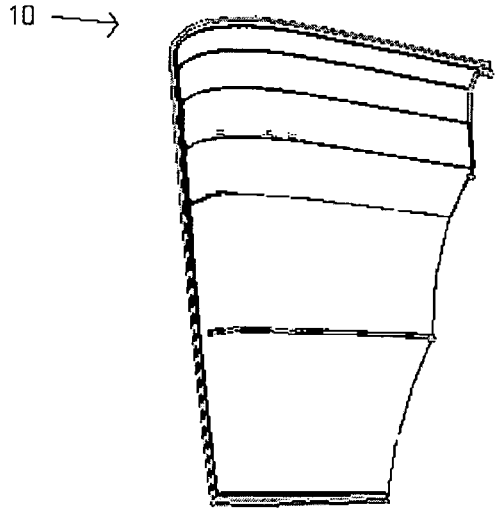

Turning now to FIGS. 4-8, are perspective bottom views, FIGS. 9-12 are perspective orthogonal views, FIGS. 13-16 are perspective front views and FIGS. 17-20 are perspective side views of a LEI kite showing different aspects of trim line control and sheeting control as described above. In particular, FIGS. 4, 9, 13 and 17 show kite 10 having a profile exhibiting increased projected area and an effectively higher aspect ratio obtained by fully engaging user adjustable length device 40 and sheeting control bar 26 in. FIGS. 5, 10, 14 and 18 show kite 10 having a profile exhibiting an effectively lower aspect ratio as compared to FIG. 4, while maintaining increased projected area according to the invention, obtained by shortening trim line 24 a moderate amount and sheeting control bar 26 in. FIGS. 6, 11, 15 and 19 show kite 10 having a profile exhibiting an increased projected area and an effectively higher aspect ratio obtained by shortening trim line 24 a moderate amount and sheeting control bar 26 out for maximum upwind performance. FIGS. 7, 12, 16 and 20 show kite 10 having a profile exhibiting relatively decreased projected area obtained by setting trim line 24 to its maximum extension. FIGS. 7 and 8 show the effect of sheeting the control bar 26 in and out respectively, with user adjustable length device disengaged.

As discussed above, the control systems of the invention couple improved aerodynamic performance with enhanced safety. Specifically, shortening the length of trim line 24 relative to the other flying lines offers the option of fully depowering the kite. This can be achieved either by manually pulling on handle 50 while the user remains secured to chicken loop line 28 or by attaching safety line 48 to trim line 24, thus allowing the user to disengage from chicken loop line 28 and drop control bar 26.

Trim line 24 also facilitates the relaunch of kite 10, allowing kite 10 to be rolled onto its back from a face down position, and relaunched with controlled power by adjusting tension on trim line 24.

Control systems embodying adjustable trim lines according to the invention also allow the user to adjust the handling characteristics as desired. For example, it is recognized that conventional four line kites exhibit a characteristic feel when steering the kite in flight. Certain kites tend to balance more force on the front lines, and thus little force is transmitted through the steering lines, generating relatively light bar pressure. On the other hand, other kite designs transmit more pull to the steering lines. Thus, in use, the user has to overcome greater resistance when sheeting in the control bar, creating relatively heavier bar pressure. Each design offers various advantages and drawbacks, depending on the wind conditions and the preferences of the user. By employing user adjustable length device 40 to change the length of trim line 24, a user can adjust the feel of the kite between light and heavy bar pressure.

Figure 21:
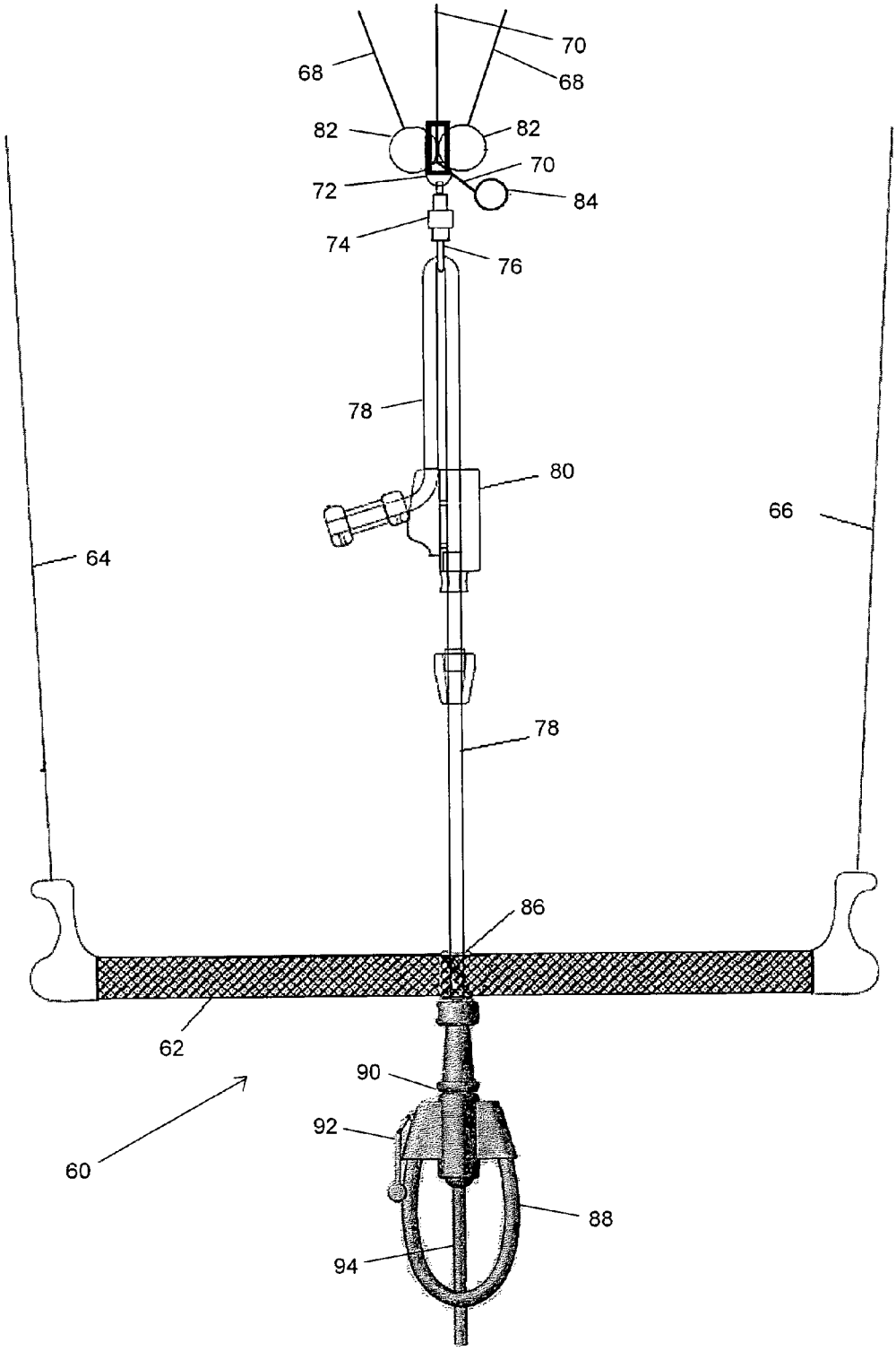
FIG. 21 is a perspective view of an alternate control device, according to the invention.

An alternate embodiment of the invention is shown in FIG. 21, wherein a control device 60 is shown and comprises a control bar 62 with steering lines 64 and 66, front lines 68 and trim line 70. This embodiment acts to adjustably trim the kite in the same general manner as the embodiments discussed above. In this embodiment, user adjustable length device 72 is positioned distal of the control bar 60 with respect to the user. Adjustable length device 72 has a swivel attachment 74 to ring 76, to help prevent twists from developing in the front lines 68 and trim line 70. Chicken loop line 78 is secured to ring 76, by doubling back to depower adjustment 80 as shown. By cleating or otherwise fixing chicken loop line 78 at depower adjustment 80, the length of chicken loop line 78 can be adjusted. Two ears 82 are also secured to swivel attachment 74, to facilitate connection to front lines 68. Trim line 70 extends through user adjustable length device 72, and can be fixed at a desired length as described above. Handle 84 is secured to the end of trim line 70 to allow easy adjustment of the length of trim line 70.

Chicken loop line 78 extends through aperture 86 in control bar 62 and terminates in chicken loop 88. Preferably, chicken loop 88 is attached to chicken loop line 78 by a swivel attachment 90, such as a ball bearing race or other similar mechanism. Also preferably, chicken loop 88 has a quick release safety 92 that allows the user to open loop 88, releasing chicken loop line 78 without unhooking. Chicken loop 88 can also have a length of tubing 94 to help prevent unintentional detachment.

Positioning user adjustable length device 72 distal to control bar 62 still allows ready access to all the length adjustments and benefits associated with having increased control over the trim of the kite. This configuration is not as preferred for attaching a safety line to trim line 70, however. The position of user adjustable length device 72 allows twists to develop in a safety line secured to trim line 70 when the bar is rotated or the kite is looped. Nevertheless, this configuration is still suitable, particularly in situations where other safety provisions have been made or when rotations of the kite or control bar are unlikely.

Described herein is a preferred embodiment, however, one skilled in the art that pertains to the present invention will understand that there are equivalent alternative embodiments. In particular, the preferred embodiments described involve a four line control system with a trim line, wherein the trim line and chicken loop line are routed through the control bar and wherein the user adjustable length device is located proximal to the control bar. Nevertheless, other embodiments are suitable for the practice of the invention including systems wherein the user adjustable length device is located distal to the control bar or systems utilizing only two steering lines and the trim line. As such, these changes and modifications are properly, equitably, and intended to be, within the full range of equivalence of the following claims.

What is claimed is:

1. An aerodynamic wing comprising a leading edge, a trailing edge, first and second opposing wingtips, a control device, a first steering line secured to the first wingtip and the control device, a second steering line secured to the second wingtip and the control device, and a trim line secured to the leading edge between the opposing wingtips, wherein the trim line has a relative length between the leading edge and a user adjustable length device, wherein the user adjustable length device allows the user to vary the relative length and mechanically fix the trim line at the varied length while the aerodynamic wing is in flight.

2. The wing of claim 1, wherein the trim line is configured to be secured to the control device.

3. The wing of claim 1, wherein the trim line is configured to be releasably secured to a user.

4. The wing of claim 1, further comprising two front lines, wherein a first front line is secured to the first wingtip adjacent the leading edge and wherein a second front line is secured to the second wingtip adjacent the leading edge.

5. The wing of claim 4, wherein the front lines are adapted to be releasably secured to a user.

6. The wing of claim 5, wherein the control device comprises a bar, with the steering lines secured to opposing ends of the bar, and wherein the front lines are releasably secured to a user through an aperture in the control device.

7. The wing of claim 6, wherein the front lines are secured to a chicken loop line having a tubular construction, wherein the trim line is routed coaxially through at least a portion of the chicken loop line to the user adjustable length device, and wherein the user adjustable length device is located between the control bar and the user.

8. The wing of claim 1, wherein the user adjustable length device is located between the control device and the wing.

9. The wing of claim 1, wherein the aerodynamic wing has an angle of attack and wherein the trim line is configured to adjust the angle of attack in a range between a first position and a second position and wherein the user adjustable length device is configured to fix the trim line at lengths corresponding to an angle of attack between the first position and the second position.

10. The wing of claim 1, wherein the aerodynamic wing has a projected area and wherein the trim line is configured to adjust the projected area in a range between a first amount and a second amount and wherein the user adjustable length device is configured to fix the trim line at lengths corresponding to a projected area between the first amount and the second amount.

11. The wing of claim 10, wherein the aerodynamic wing has an angle of attack and wherein the trim line is configured to adjust the angle of attack in a range between a first position and a second position and wherein the user adjustable length device is configured to fix the trim line at lengths corresponding to an angle of attack between the first position and the second position.

12. A method for controlling an aerodynamic wing having a leading edge and first and second opposing wingtips, comprising the steps of:

providing a control device, a first steering line secured to the first wingtip and the control device, a second steering line secured to the second wingtip and the control device, and a trim line secured to the leading edge between the opposing wingtips, wherein the trim line has a relative length between the leading edge and a user adjustable length device, wherein the user adjustable length device allows the user to vary the relative length and mechanically fix the trim line at the varied length while the aerodynamic wing is in flight;

varying the length of the trim line from a first length to a second length while the aerodynamic wing is in flight; and mechanically fixing the trim line at the second length.

13. The method of claim 12, wherein the aerodynamic wing has an angle of attack and wherein the step of varying and mechanically fixing the trim line comprises altering the angle of attack of the aerodynamic wing.

14. The method of claim 12, wherein the aerodynamic wing has a projected area and wherein the step of varying and mechanically fixing the trim line comprises altering the projected area of the aerodynamic wing.

15. The method of claim 14, wherein the aerodynamic wing has an angle of attack and wherein the step of varying and mechanically fixing the trim line comprises altering the angle of attack of the aerodynamic wing.

16. The method of claim 12, wherein the aerodynamic wing generates an aerodynamic lift, further comprising the step of increasing the aerodynamic lift by shortening and mechanically fixing the trim line.

17. The method of claim 12, wherein the control device further comprises front lines secured to the wingtips adjacent the leading edge, further comprising the step of positioning the aerodynamic wing further forward in a wind window by increasing the length of the steering lines relative to the front lines.

18. The method of claim 12, further comprising the step of altering the position of the aerodynamic wing within a wind window by the step of varying the length of the trim line.

* * * * *